United States Patent [19]

Jedziniak

[11] Patent Number: 4,493,267

[45] Date of Patent: Jan. 15, 1985

[54] SECURABLE STORAGE ASSEMBLY FOR DATA PROCESSING DEVICE

[76] Inventor: Francis J. Jedziniak, 2352 W. 227th St., Torrance, Calif. 90501

[21] Appl. No.: 340,115

[22] Filed: Jan. 18, 1982

[51] Int. Cl.[3] ..... G06C 7/02

[52] U.S. Cl. ..... 108/50; 108/143; 312/236

[58] Field of Search ..... 108/59, 92, 102, 143, 108/50; 312/236, 201, 250, 251

[56] References Cited

U.S. PATENT DOCUMENTS

| | | | |
|---|---|---|---|
| 2,182,703 | 12/1939 | Rainwater | 108/143 X |
| 2,341,125 | 2/1944 | Spear | 312/236 |
| 2,346,985 | 4/1944 | Mercur | 108/102 |
| 4,078,396 | 3/1978 | Penizotto | 312/236 X |
| 4,113,223 | 9/1978 | Kakizaki | 108/143 X |
| 4,260,208 | 4/1981 | Ho et al. | 312/236 X |
| 4,316,082 | 2/1982 | Fritz | 108/92 X |
| 4,379,429 | 4/1983 | Gubbe et al. | 108/143 X |

*Primary Examiner*—William E. Lyddane
*Assistant Examiner*—Peter A. Aschenbrenner
*Attorney, Agent, or Firm*—Michael Bak-Boychuk

[57] ABSTRACT

A shelfing system is disclosed herein for use in storing data processing devices, said shelfing system including cooling blowers in the surfaces thereof for cooling the electronic equipment stored therein. The shelfing system, furthermore, is pivotally fastened for convenient maintenance access with the pivotal motion thereof restrained by a locking mechanism. Thus the user has access to all of the operative features of the data processing device while the device itself is retained against unauthorized withdrawal.

3 Claims, 9 Drawing Figures

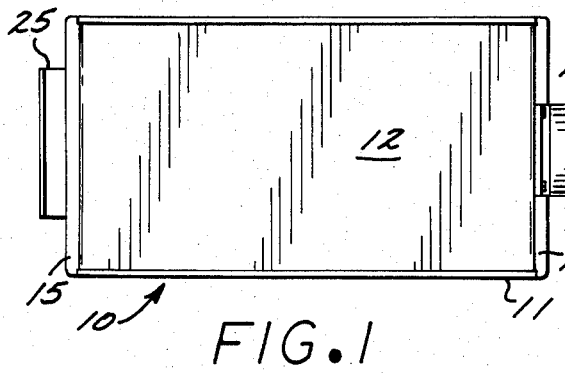
FIG. 1
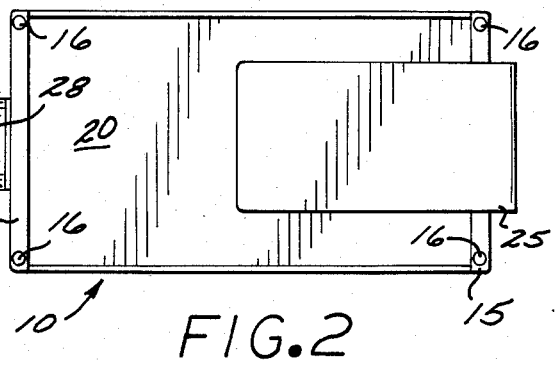
FIG. 2
FIG. 3
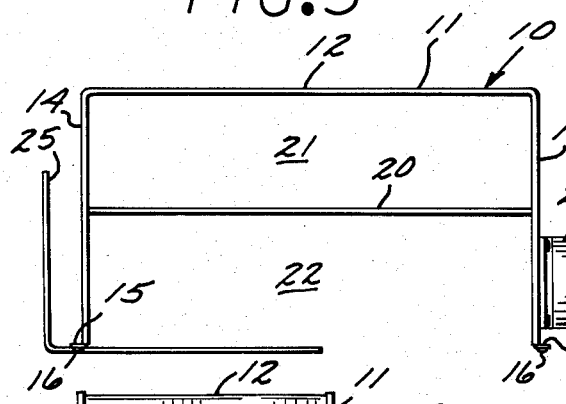
FIG. 4
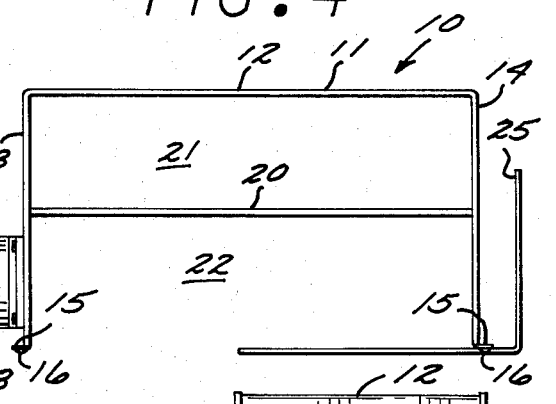
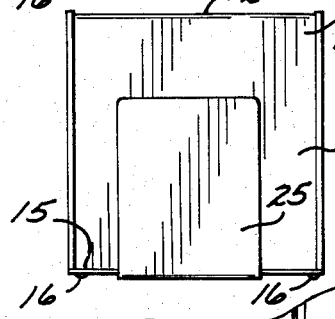
FIG. 5
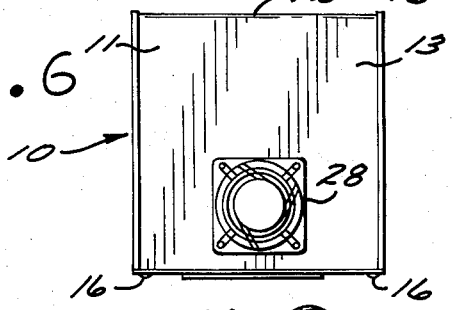
FIG. 6
FIG. 7
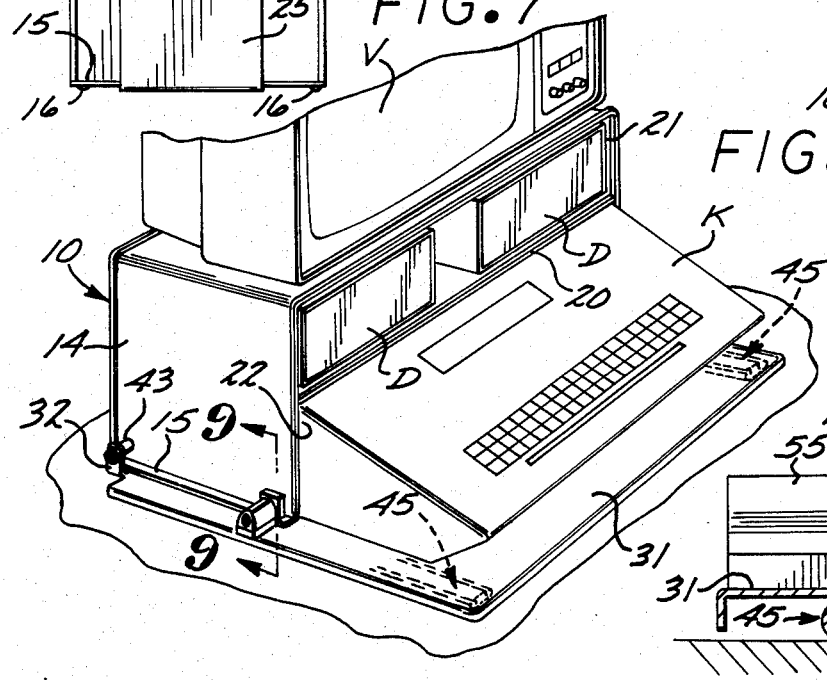
FIG. 8
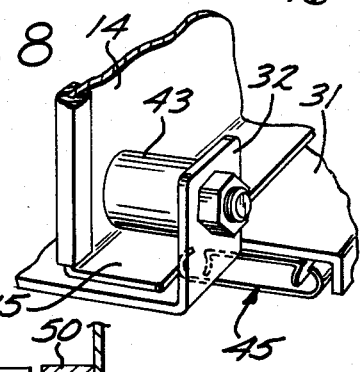
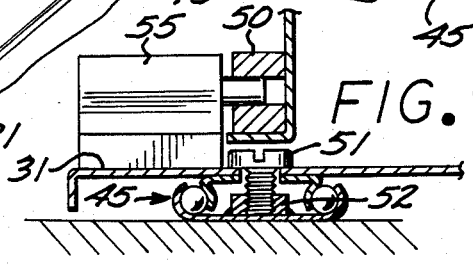
FIG. 9

SECURABLE STORAGE ASSEMBLY FOR DATA PROCESSING DEVICE

BACKGROUND OF THE INVENTION

1. Field of the Invention

The present invention relates to storage assemblies, and more particularly to shelfing systems conformed for use with data processing devices.

2. Description of the Prior Art

Storage of electronic equipment in convenient alignment for periodic use typically entails the resolution of various competing perameters thus rendering the eventual solution often less than optimum. For example, high density storage must necessarily contemplate the cooling requirements of any electronic device which must resolve itself with the security of the installation and cost. Concurrently appearance factors and convenience of storage of various incidental articles must be considered in order to render the whole package as acceptable to the eventual consumer as possible. For this reason various techniques have been sought in the past to simplify the structure resolving these competing functions and it is one such structure uniquely suited for data processing systems that is disclosed herein.

SUMMARY OF THE INVENTION

Accordingly it is the general purpose and object of the present invention to provide a storage system for data processing devices which, in convenient form, provides both facility in use and ventilation for cooling.

Other objects of the invention are to provide a storage system for electronic devices which may be conveniently converted to a secured configuration.

Yet additional objects of the invention are to provide a storage system for storing data processing devices which is easy to produce, requires few parts and is conveniently used.

Briefly these and other objects are accomplished within the present invention by providing a sheet metal bracket, generally conformed in the manner of an inverted "U" and having the spread between the legs thereof substantially equal to the width of a data processing keyboard unit. The bracket, on the interior thereof, is joined to a transverse shelf cooperating with the top of the bracket to define a space conformed to receive one or more disc packs used in conjunction with the keyboard system. On the upper surface the bracket provides a support for a video unit, thus storing in combination all the necessary elements for a data processing system. The bracket itself may include at the bottom edges thereof outwardly turned projections which engage a plurality of footpads between which an L-shaped bookstand may be inserted. Furthermore, one lateral surface of the bracket may be provided with a cooling fan which upon proper orientation of the bracket can be aligned with the cooling inlets in the keyboard device. In this form the shelf assembly may be pivotally mounted to a base plate supported on roller slides. A lock mechanism engages a lock plate against the bracket and the slide thus hiding any possible access to the working apertures in the equipment against unauthorized entry.

This set of features is uniquely adapted for installing data processing systems in schools or other areas where security is of significance. Furthermore, this set of features combine uniquely to provide ease of maintenance since only one locking sequence is necessary in order to obtain full access to all of the working areas.

BRIEF DESCRIPTION OF THE DRAWINGS

FIG. 1 is a top view of an inventive shelfing unit constructed according to the disclosure herein;

FIG. 2 is a bottom view of the inventive shelfing unit shown in FIG. 1;

FIG. 3 is a front view of the shelfing unit shown in FIG. 1;

FIG. 4 is a rear view of the shelfing unit shown in FIG. 1;

FIG. 5 is one side view of the shelfing unit shown in FIG. 1;

FIG. 6 is another side view, illustrating the venting arrangement in the inventive shelfing unit disclosed in FIG. 1;

FIG. 7 is an assembly view, in perspective, illustrating the shelfing unit shown in FIGS. 1–6 as assembled into a secured configuration;

FIG. 8 is a detail view, in perspective, illustrating the pivot connection useful with the shelfing unit disclosed herein; and FIG. 9 is a front view detail of the secured installation of the shelfing unit according to the present invention herein.

DESCRIPTION OF THE SPECIFIC EMBODIMENT

As shown in FIGS. 1–6 the inventive shelfing unit, generally designated by the numeral 10, comprises a sheet metal panel of substantially rectangular plan form convolved to form a hat or inverted U section to define a brace 11 having a horizontal flat surface 12 supported by two vertical surfaces 13 and 14 which, at the free edges thereof, are bent into outwardly extending ridges 15 to which rubber foot pads 16 are adhesively attached. Legs 13 and 14 at a point subjacent surface 12, are joined by a horizontal panel or shelf 20 thus defining an upper storage cavity 21 and a lower storage cavity 22. When supported on a flat surface the spacing between foot pads 16 allows for the insertion of one leg of an L-shaped book rack 25 which is retained against pivotal motion by any electronic equipment received in cavity 22. Furthermore, the lateral leg or surface 13 may include a fan assembly 28 which draws air from the environment and directs it into cavity 22.

Cavity 22 may be dimensioned to receive the keyboard unit of any data processing device shown herein as keyboard unit K which when inserted will align the vent openings thereof adjacent the outlet of the fan assembly 28. Thus the air drawn by the fan assembly 28 will now circulate through the interior of the keyboard assembly cooling any heat sources included therein. In turn, the upper cavity 21 may be conformed to receive one or more peripheral devices such as disc pack D which in normal use provides the necessary memory space for the keyboard articulated data processing system.

The foregoing data processing compliments may be further expanded to include a video screen on which any information associated with the processing is displayed. This video screen V may be stored on the upper surface 12 thus providing all of the necessary features of a data processing device in one useful assembly arrangement.

The foregoing shelfing unit 10, according to the illustrations in FIGS. 7, 8 and 9, may be placed onto a flat surface 31 provided with vertical tabs 32 at the rear edge thereof. Tabs 32 are separated relative each other by the dimensions equal to the separation across ridges 15 to provide through spacers 43 pivot points for the shelfing unit 10. More specifically, tabs 32 may be joined to the lateral surfaces 13 and 14 by way of fasteners 33. In this configuration the outwardly bent lips or ridges 15 overlie the surface 31 which, in turn, is supported on slides 45 dimensioned to the same spread. The surface 31 together with the laterally extending ridges 15 may then be locked against sliding translation by a screw 51 extending into a bore formed in one of the slides 45. This screw 51 extends downwardly from a point subjacent ridge 15 to engage a boss 52 formed in the fixed runner of the slide. A plate 50 attached to the leg 14, in turn, may be engaged by a lock assembly 55 secured to surface 31 to lock the shelf unit 10 against pivoting, thus preventing the withdrawal of the screw 51 until it is unlocked. In this manner the video screen V, the disc packs D and the key-board K may be secured to the shelfing unit, precluding unauthorized withdrawal.

Thus the shelfing 10, while useful on its own, may be conformed for secured installation without loss of integrity of operative features. This retention assures a secured enclosure for the data processing equipment hereinbefore mentioned which while thus secured is fully accessible to the user. In this form all the necessary access to ventilation and maintenance is retained while insuring the equipment against unauthorized loss or withdrawal.

Obviously many modifications and changes may be made to the foregoing description without departing from the spirit of the invention. It is therefore intended that the scope of the invention be determined solely on the claims appended hereto.

What is claimed is:

1. A storage system for storing a complement of data processing devices comprising:

a slidably mounted support plate;

a shelf unit pivotally mounted on said support plate, said shelf unit including a bracket formed as an inverted U-shaped structure having vertical surfaces joined by a horizontal panel and a shelf attached below said horizontal panel, said shelf and bracket cooperating to form an upper and lower cavity conformed to receive data processing devices;

pivot means connected between said support plate and the free ends of said vertical panels for providing pivotal articulation of said shelf unit relative said support plate; and lock means for selectively engaging said shelf unit to said support plate and for restraining said unit against pivotal movement relative said support plate.

2. Apparatus according to claim 1 further comprising:

a blower attached to one vertical panel of said shelf unit for drawing air into said lower cavity.

3. Apparatus according to claim 2 wherein:

said lower cavity is conformed to receive a data processing keyboard unit.

* * * * *